United States Patent [19]

Grawi

[11] Patent Number: 4,637,290

[45] Date of Patent: Jan. 20, 1987

[54] VARIABLE PITCH HARP

[76] Inventor: Robert S. Grawi, 655 - 6th Ave., Rm. 215, New York, N.Y. 10010

[21] Appl. No.: 784,617

[22] Filed: Oct. 4, 1985

[51] Int. Cl.[4] ..... G10D 3/04

[52] U.S. Cl. ..... 84/173; 84/293; 84/307

[58] Field of Search ..... 84/173, 267, 291, 293, 84/307, 312

[56] References Cited

U.S. PATENT DOCUMENTS

| | | | |
|---|---|---|---|
| 1,410,504 | 3/1922 | Post | 84/173 |
| 3,447,412 | 6/1969 | Marshall | 84/267 |
| 4,481,856 | 11/1984 | Grawi | 84/173 |

*Primary Examiner*—Lawrence R. Franklin

*Attorney, Agent, or Firm*—Richard L. Miller

[57] ABSTRACT

A variable pitch harp is provided which allows the player to change the pitch of all of the plucked, struck or bowed strings at the same time as he is playing. In the first embodiment, the bridge of the harp is moved up or down as the player moves the harp towards or away from his body and the sound is amplified electronically via an acoustical pickup. In the second embodiment, a sounding drum is provided whose resonance provides acoustical amplification so that the instrument may be played without electronic amplification. In the third embodiment an electronic version is provided in which the bridge is fixed-mounted but the instrument itself may be flexed to change tone. For all embodiments a quick tuning attachment is also provided.

10 Claims, 10 Drawing Figures

4
4
A
B 66
40a
42a
22a
38a 22a
42a
78
84
82
74
64
66
62
86
68
38a
70
6
6
7
7
72
80
76
24a
22a 104
98
92

22 or 22a or 22b
102
104
92
10
10
100
98
94
90
96

38b
60b
22b
20b

VARIABLE PITCH HARP

BACKGROUND OF THE INVENTION

This invention relates generally to stringed musical instruments and in particular to stringed musical instruments whose pitch may be continuously altered over some fixed range of pitch.

There are a number of stringed instrument available in which the strings are either plucked, struck or bowed. Most of these instruments are tuned before playing by adjusting the tension on the various strings which invariably pass over or through some kind of bridge. Instruments such as guitars and violins are fixed tuned according to some reference such as a pitch-pipe. When played the tension and/or length of the strings is shifted by pressing the strings against some fixed surface, typically using the frets as a guide.

R. Grawi (U.S. Pat. No. 4,481,856) provides a good example of a novel approach to the design of a multi-stringed instrument which gives good performance and may be amplified using an electro-acoustical transducer or pickup. However, even Grawi's invention stops short of providing continuously variable pitch.

SUMMARY OF THE INVENTION

It is, therefore, a primary object of the present invention to provide a variable pitch harp in which the pitch is continuously variable by moving the bridge itself which is attached to a variable pitch tensioning arm.

Another object is provide a variable pitch harp with an acoustical pickup so that the emitted sound may be amplified.

Yet another object is provide a variable pitch harp with a sounding drum so that the resonance of the drum allows the harp to be played without any electronic amplification.

Yet another object is provide a variable pitch harp whose pitch may be varied by moving the harp towards and away from the player using a chest band with a tensioning cord attached to the instrument. Allowing the player to vary the pitch while continuing to play with the fingers of both hands.

A still further object is provide a variable pitch harp with a fixed bridge and yet still be able to vary the pitch of the instrument by slightly bowing part of the harp's body itself.

A still further object is provide a variable pitch harp which is simple and inexpensive to fabricate and simple and fun to play.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2, 3, 4:
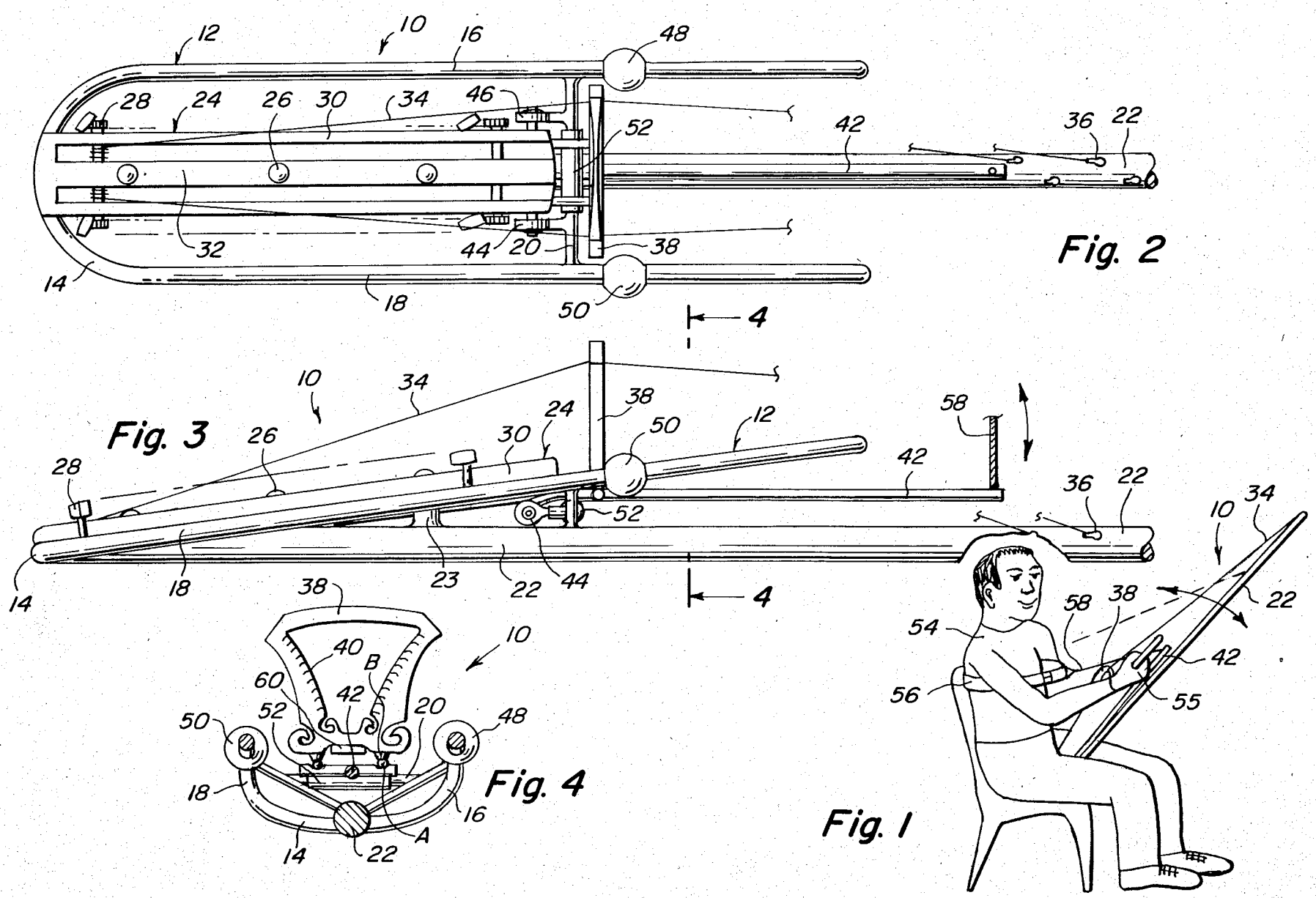
FIG. 1 illustrates the invention in use.
FIG. 2 is a top view of a first embodiment of the invention with electronic amplification.
FIG. 3 is a side view thereof.
FIG. 4 is a cross sectional view taken on line 4—4 in FIG. 3.

The first embodiment of the invention, an electronically amplified variable pitch harp, may best be understood with reference to FIGS. 1, 2, 3, and 4. The harp 10 is built around a U-shaped frame 12 typically made of stainless steel tubing with curved section 14 and parallel arms 16 and 18. A cross member 20 spans the parallel arms and adds rigidity and reinforcement. An elongated member 22 begins in the middle of curved section 14 and is equidistant from parallel arms 16 and 18 and protrudes considerably beyond them. Additional support is provided by stanchion 23. A head 24, typically made of wood, sits atop elongated member 22 and is attached by three cap nuts typified by 26. String tuning devices, typified by 28, with rotating shafts which protrude through tuning device support 30 and center support 32, are used to adjust the tension on strings such as 34. The opposite ends of the strings are anchored in keyhole shaped string anchor apertures, typified by 36, by knots in the ends of the strings and catching the knots in the key-hole shaped apertures.

Each of the strings must pass through bridge 38 which is provided with a number of notches typified by notch 40. Bridge 38 is seated on two ball bearings A set in two holes on the top of a fork-shaped variable pitch tensioning arm 42 whose open fork end is pivoted at pivot arms 44 and 46, which are attached to cross member 20. When variable pitch tensioning arm 42 is pulled up and away from elongated member 22 bridge 38 is also raised, tension on all of the strings is increased and the pitch of the strings rises.

As bridge 38 rises, bearing seat B embedded in bridge 38 slowly rotate over ball bearings A allowing the bridge 38 to maintain its orientation in space and transfer no displacement movement along the length of string 34. This greatly reduces string wear at the bridge 38 and allows the instrument to remain in tune over repeated tensionings.

Spherical wooden grips 48 and 50 are provided so that the player's hands can get a firm grip. A cylindrical padded rest 52 prevents the fork-shaped tensioning arm 42 from causing damage to itself and bridge 38 when arm 42 is allowed to fall quickly. An acoustical pickup 60 picks up vibration and converts them to electrical signals which are then amplified and outputted through a loudspeaker.

In use, a player 54, wears a chest band 56 which is attached to a variable pitch tensioning cord 58 which is attached to tensioning arm 42. When the harp 10 is pushed away from player 54 tension is placed on the strings and the pitch goes up. Meanwhile the player 54, while using his arm to tension the bridge, has not changed the position of his hands and fingers in relation to the strings and can continue playing the strings without interruption.

Figures 5, 6, 7, 8, 9, 10:
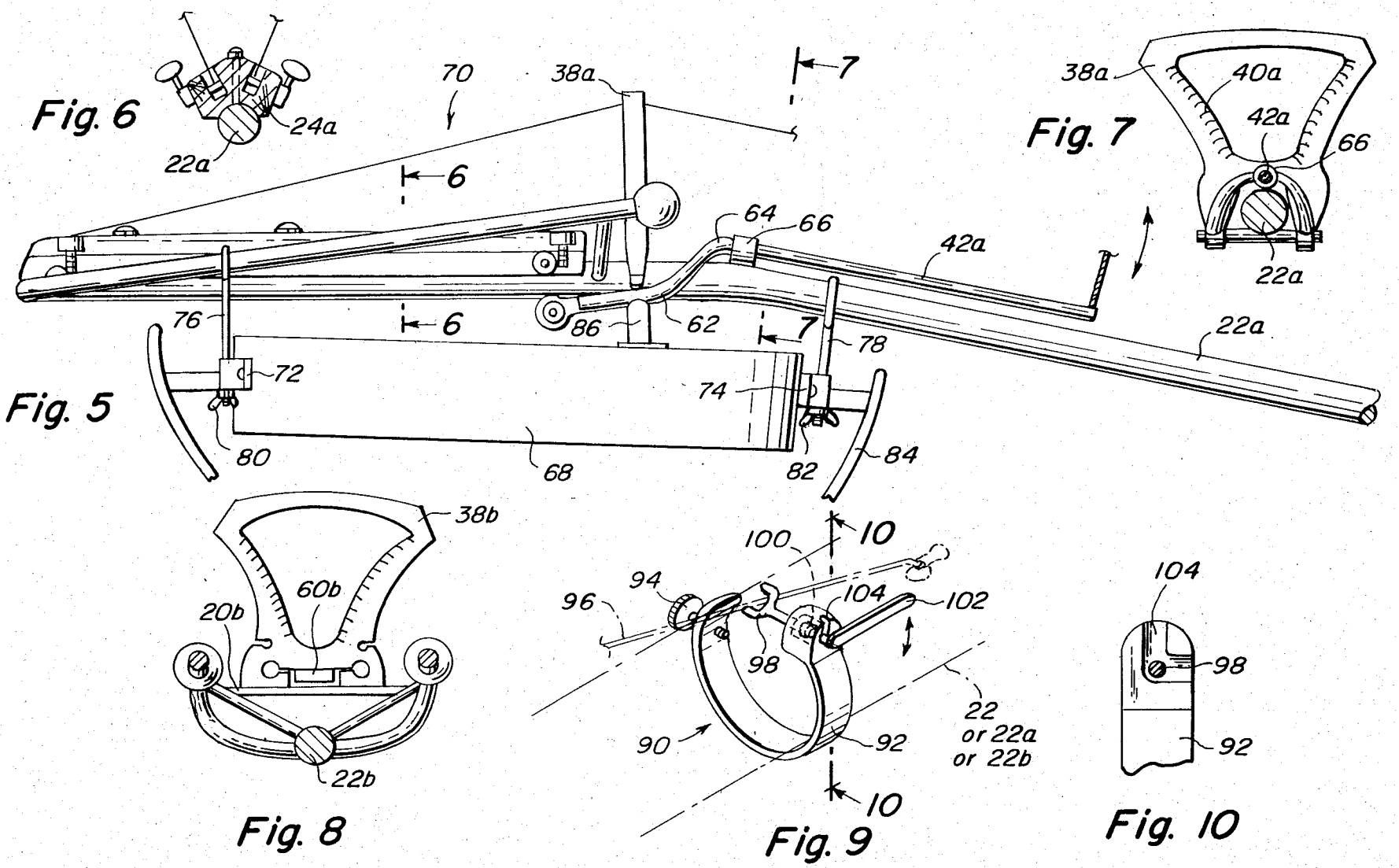
FIG. 5 is a side view of a second embodiment showing a sounding drum attached thereto.
FIG. 6 is a cross sectional view taken on line 6—6 in FIG. 5.
FIG. 7 is a cross sectional view taken on line 7—7 in FIG. 5.
FIG. 8 is a cross sectional view similar to FIG. 3 of a third embodiment showing a fixed bridge.
FIG. 9 is a perspective view of a quick tuning attachment.
FIG. 10 is a cross sectional view taken on line 10—10 in FIG. 9.

The second embodiment of the invention a higher pitched soprano version in which the sound is amplified acoustically by a resonant sounding drum may best be understood with reference to FIGS. 5, 6 and 7. This embodiment is similar to the electrically amplified version already described, so only differences will be enumerated. Head 24*a* is lowered and straddles member 22*a* for its whole length as seen in FIG. 6. Elongated member 22*a* is bent downwards in FIG. 5 instead of being straight. This also affects the shape of fork-shaped variable pitch tensioning arm 42*a* which is offset at 62 and 64 instead of being straight. These variations allow the bridge 38*a* to straddle the neck 22*a* and greatly reduces the distance between notch 40*a* and neck 22*a* allowing the treble string to be shorter and therefore the entire instrument to be higher pitched. This is apparent when comparing FIG. 4 with FIG. 7. The pad 66 is now located on the tensioning arm 42*a*. A sounding drum 68 has been added which supports harp 70 by using a series of clamps such as 72 and 74, harp support bars such as 76 and 78, and wings nuts such as 80 and 82. A vibration transmitter 86 transmits vibrations to sounding drum 68. A resonator 84 is also provided.

In the third embodiment, best understood with reference to FIG. 8, the bridge 38*b* is fixed in position on cross member 20*b*. In this embodiment the pitch of the harp is changed by slightly bowing elongated member 22*b*. An acoustical pickup 60*b* is provided.

As shown in FIGS. 9 and 10, a quick tuning attachment 90 may be used with any of the three embodiments. A circular clamp 92 fits around elongated member 22 or 22*a* or 22*b* and is held in place by knurled head screw 94. A string typified by 96 passes through the open end of spade lug 98 which passes through circular clamp 92 and is biased in position by helical return spring 100. The rotational position of spade lug 98 is varied by the position of variable pitch control lever 102 whose travel is limited by locking tab 104.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A variable pitch harp, comprising in combination:

(a) a U-shaped frame, made of a rigid material, with elongated parallel arms;

(b) a rigid bowed cross member which spans said elongated parallel arms and is perpendicular to said arms such that said U-shaped frame is strengthened;

(c) an elongated member connected to said U-shaped frame at the center of the curved section of said U-shaped frame such that said elongated member is equidistant from said parallel arms and lies in a plane which forms an acute angle with the plane of said parallel arms; wherein said elongated member also contains a multiplicity of string anchor apertures to which strings may be attached;

(d) a head, made of an acoustical semi-resilient material such as wood, wherein said head is attached to the upper surface of said elongated member and is located in the region between the curved section of said U-shaped frame and said rigid cross member; whereby said head comprises a center support section and two tuning device supports each adjacent to said center support;

(e) a multiplicity of strings;

(f) a multiplicity of string tuning devices which are used to adjust the tension on each of said multiplicity of strings, whereby each of said strings is attached to said elongated member at one of said string anchor apertures while the other end of said string is attached to said string tuning device, such that the invention may be tuned prior to playing;

(g) a bridge, located between said string tuning devices and said string anchor apertures, with a multiplicity of notches through which pass each of said strings such that each string is separated from every other string while still being held under tension; and, (h) a variable pitch tensioning arm, pivoted in a vertical plane relative to the plane of said parallel arms on a pivot consisting of at least one pivot arm connected perpendicularly to said cross member and a pivot pin; wherein said tensioning arm is forked with the opening at the pivot points, such that said bridge spans the opening of said fork, such that when said tensioning arm is raised said bridge is also raised, thereby increasing tension on all of said strings and raising the pitch of the emitted sounds when such strings are bowed, plucked or struck.

2. A variable pitch harp, as recited in claim 1, further comprising spherical wooden grips with radial apertures such that they may be mounted coaxially to the open ends of said parallel arms.

3. A variable pitch harp, as recited in claim 1, further comprising a variable pitch tensioning cord attached to the free end of said tensioning arm and a chest band to which the free end of said cord is attached such that when said chest band is worn by the user, if said pitch harp is moved away from said user said tensioning arm is raised and thereby the pitch of the sound is also raised.

4. A variable pitch harp, as recited in claim 1, further comprising a cylindrical padded rest mounted coaxially to said cross member such that when tension on said tensioning arm is released said tensioning arm and said attached bridge are not brought into dangerous collision with said cross member.

5. A variable pitch harp, as recited in claim 1, further comprising an acoustical/electrical pickup, mounted into a recess in the base of said bridge, such that mechanical vibrations may be converted to electrical signals and thereafter amplified.

6. A variable pitch harp, comprising in combination:

(a) a U-shaped frame, made of a rigid material, with elongated parallel arms;

(b) a rigid bowed cross member which spans said elongated parallel arms and is perpendicular to said arms such that said U-shaped frame is strengthened;

(c) an elongated member connected to said U-shaped frame at the center of the curved section of said U-shaped frame such that said elongated member is equidistant from said parallel arms and lies in a plane which forms an acute angle with the plane of said parallel arms; wherein said elongated member also contains a multiplicity of string anchor apertures to which strings may be attached;

(d) a head, made of an acoustical semi-resilient material such as wood, wherein said head is attached to the upper surface of said elongated member and is located in the region between the curved section of said U-shaped frame and said rigid cross member; whereby said head comprises a center support section and two tuning device supports each adjacent to said center support;

(e) a multiplicity of strings;

(f) a multiplicity of string tuning devices which are used to adjust the tension on each of said multiplicity of strings, whereby each of said strings is attached to said elongated member at one of said string anchor apertures while the other end of said string is attached to said string tuning device, such that the invention may be tuned prior to playing;

(g) a bridge, located between said string tuning devices and said string anchor apertures, with a multiplicity of notches through which pass each of said strings such that each string is separated from every other string while still being held under tension;

(h) a variable pitch tensioning arm, pivoted in a vertical plane relative to the plane of said parallel arms on a pivot consisting of at least one pivot arm connected perpendicularly to said cross member and a pivot pin; wherein said tensioning arm is forked with the opening at the pivot points, such that said bridge spans the opening of said fork, such that when said tensioning arm is raised said bridge is also raised, thereby increasing tension on all of said strings and raising the pitch of the emitted sounds when such strings are bowed, plucked or struck; and, (i) a resonant sounding drum located directly beneath said elongated member; a plurality of harp support bars attached to said harp at a plurality of points and to clamps on a base which supports said sounding drum so that said harp is fixed to said sounding drum; whereby the resonant amplifying quality of said sounding drum permits said harp to be played without electronic amplification.

7. A variable pitch harp, as recited in claim 6, further comprising spherical wooden grips with radial apertures such that they may be mounted coaxially to the open ends of said parallel arms.

8. A variable pitch harp, as recited in claim 6, further comprising a variable pitch tensioning cord attached to the free end of said tensioning arm and a chest band to which the free end of said cord is attached such that when said chest band is worn by the user, if said pitch harp is moved away from said user said tensioning arm is raised and thereby the pitch of the sound is also raised.

9. A variable pitch harp, as recited in claim 6, further comprising a cylindrical padded rest mounted coaxially to said variable pitch tensioning arm such that when tension on said tensioning arm is released said tensioning arm is not brought into dangerous collision with said elongated member.

10. A variable pitch harp, as recited in claims 1, 6 or 9 further comprising a quick tuning attachment comprising a circular clamp which is held to said elongated member by a knurled head screw; a spade lug which protrudes through an aperture in said circular clamp; a helical return spring which biases said spade lug; a variable pitch control lever which is used to rotate said spade lug; and a locking tab which limits the rotation of said spade lug; whereby one of said multiplicity of strings passes through the opening in said spade lug and the tension on said string may be adjusted according to the rotation of said spade lug.

* * * * *